US012043473B1

(12) United States Patent
Koenig

(10) Patent No.: US 12,043,473 B1
(45) Date of Patent: Jul. 23, 2024

(54) COLLAPSIBLE TRIANGULAR PIZZA CONTAINER

(71) Applicant: Jeff Koenig, Aurora, OR (US)

(72) Inventor: Jeff Koenig, Aurora, OR (US)

( * ) Notice: Subject to any disclaimer, the term of this patent is extended or adjusted under 35 U.S.C. 154(b) by 0 days.

(21) Appl. No.: 18/363,653

(22) Filed: Aug. 1, 2023

(51) Int. Cl.

| | |
|---|---|
| ***B65D 85/36*** | (2006.01) |
| ***B65D 1/22*** | (2006.01) |
| ***B65D 43/02*** | (2006.01) |
| ***B65D 51/16*** | (2006.01) |

(52) U.S. Cl.
CPC ..... *B65D 85/36* (2013.01); *B65D 1/225* (2013.01); *B65D 43/0222* (2013.01); *B65D 51/16* (2013.01); *B65D 2585/366* (2013.01)

(58) Field of Classification Search
CPC ..... B65D 21/086; B65D 2585/366; B65D 51/16; B65D 1/225; B65D 85/36
See application file for complete search history.

(56) References Cited

U.S. PATENT DOCUMENTS

| | | | | |
|---|---|---|---|---|
| 2010/0176022 | A1* | 7/2010 | Furlong | B65D 25/24 206/508 |
| 2015/0253055 | A1* | 9/2015 | Tsui | B62B 5/066 280/655 |
| 2018/0118410 | A1* | 5/2018 | Wood | B65D 45/22 |
| 2021/0237933 | A1* | 8/2021 | Swarts | B65D 21/08 |

* cited by examiner

*Primary Examiner* — Anthony D Stashick
*Assistant Examiner* — L Kmet
(74) *Attorney, Agent, or Firm* — Mark S Hubert

(57) ABSTRACT

A collapsible generally triangular pizza storage container with a set of microwaveable triangular trays for the separation, microwaving and serving of individual slices of pizza. The storage container expands to approximately two times its collapsed configuration. It uses a novel, non-accordion type pleating of its side walls that allow for the container to have the same horizontal cross sectional size along the vertical axis of the container. The pleat design has three wall sections that each fold in on themselves to form a set of three nested side wall portions. Each wall section is separated from the other by a small gap. The lid also has a generally triangular configuration with a compressible gasket, a set of locking wings extending from the periphery that frictionally engage a rigid triangular top ring of the container, and a central air vent.

7 Claims, 7 Drawing Sheets

COLLAPSIBLE TRIANGULAR PIZZA CONTAINER

BACKGROUND OF THE INVENTION

Pizza is one of the staples of the American diet. The drawback is that pizza from restaurants and to-go pizza parlors, generally don't come in single serving portions. Rather, they come sliced in whole pies, enough to feed four or more people. This causes a dilemma when a pizza pie is ordered for less than four people. This causes the leftovers to be individually wrapped or put into multiple storage containers. This takes unnecessary space in the refrigerator since pizza slices are generally triangular and conventional refrigerator storage containers are square or round. Regardless, they must be microwaved individually on another plate, and both the plate and container must be washed. Slices of pizza barely crisp in the microwave on a conventional plate or napkin. Because of the way that the existing pizza storage containers expand and collapse, their corners, folds and crevices are hard to clean.

Henceforth, a dedicated pizza storage container that was adapted for the storage and reheating/crisping of multiple slices of pizza pie would fulfill a long felt need in food storage industry. This new invention utilizes and combines known and new technologies in a unique and novel configuration to overcome the aforementioned problems and accomplish this.

SUMMARY OF THE INVENTION

In accordance with various embodiments, a collapsible, triangular, multi-slice pizza storage container with a crisper and separator tray is provided.

In one aspect, a pizza container with triangular trays for use in the separation of pizza slices to be stored, as well as for use as an individual pizza slice microwaveable crisper and serving tray is provided.

In another aspect, a triangular expandable, multi-level pizza storage container with a vented, lockable lid is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF DRAWINGS

A further understanding of the nature and advantages of particular embodiments may be realized by reference to the remaining portions of the specification and the drawings, in which like reference numerals are used to refer to similar components.

DETAILED DESCRIPTION OF THE INVENTION

Figure 1:
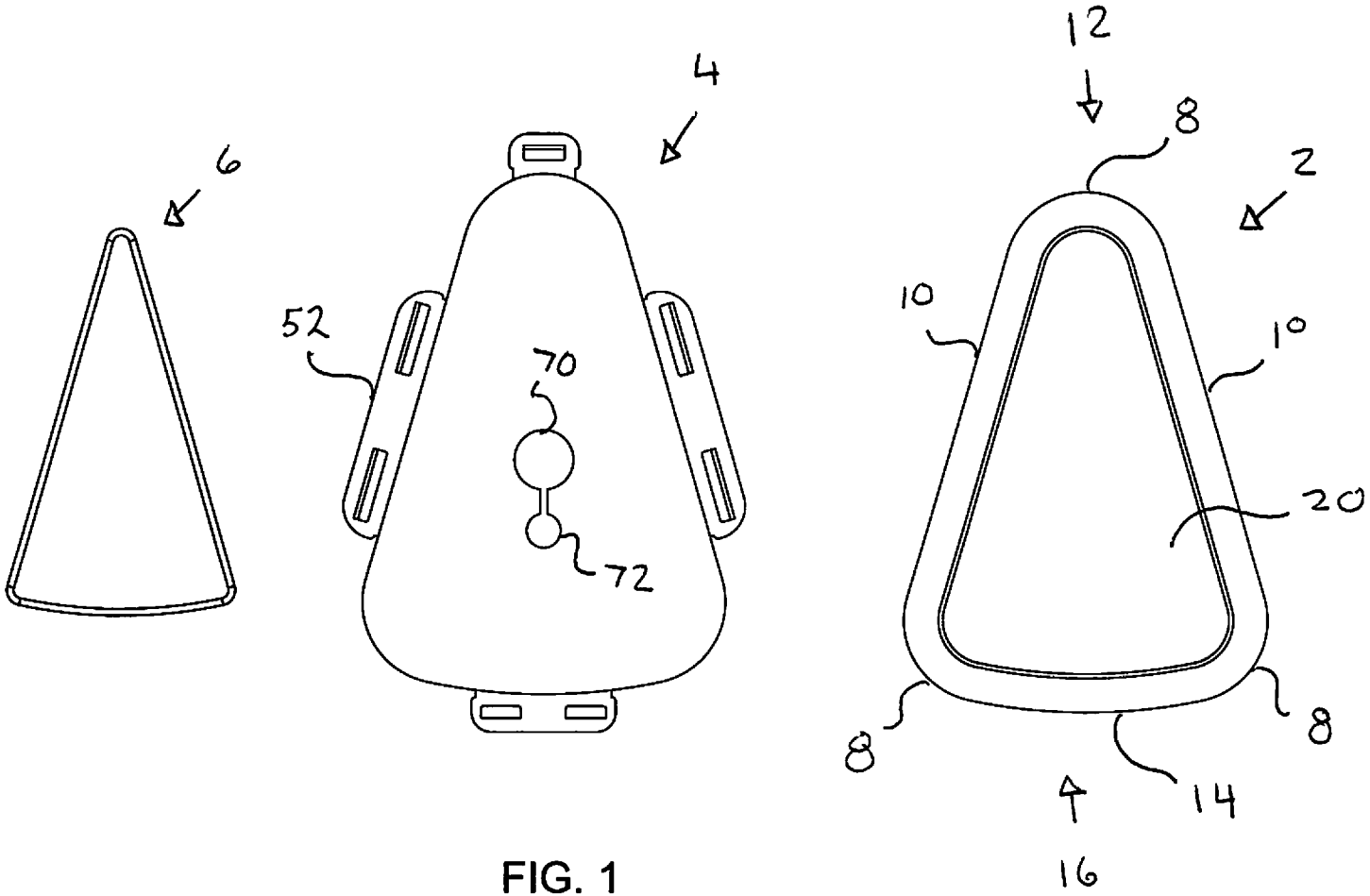
FIG. 1 is a disassembled top view of the collapsible pizza storage container, its lid and one of its trays.
Figure 2:
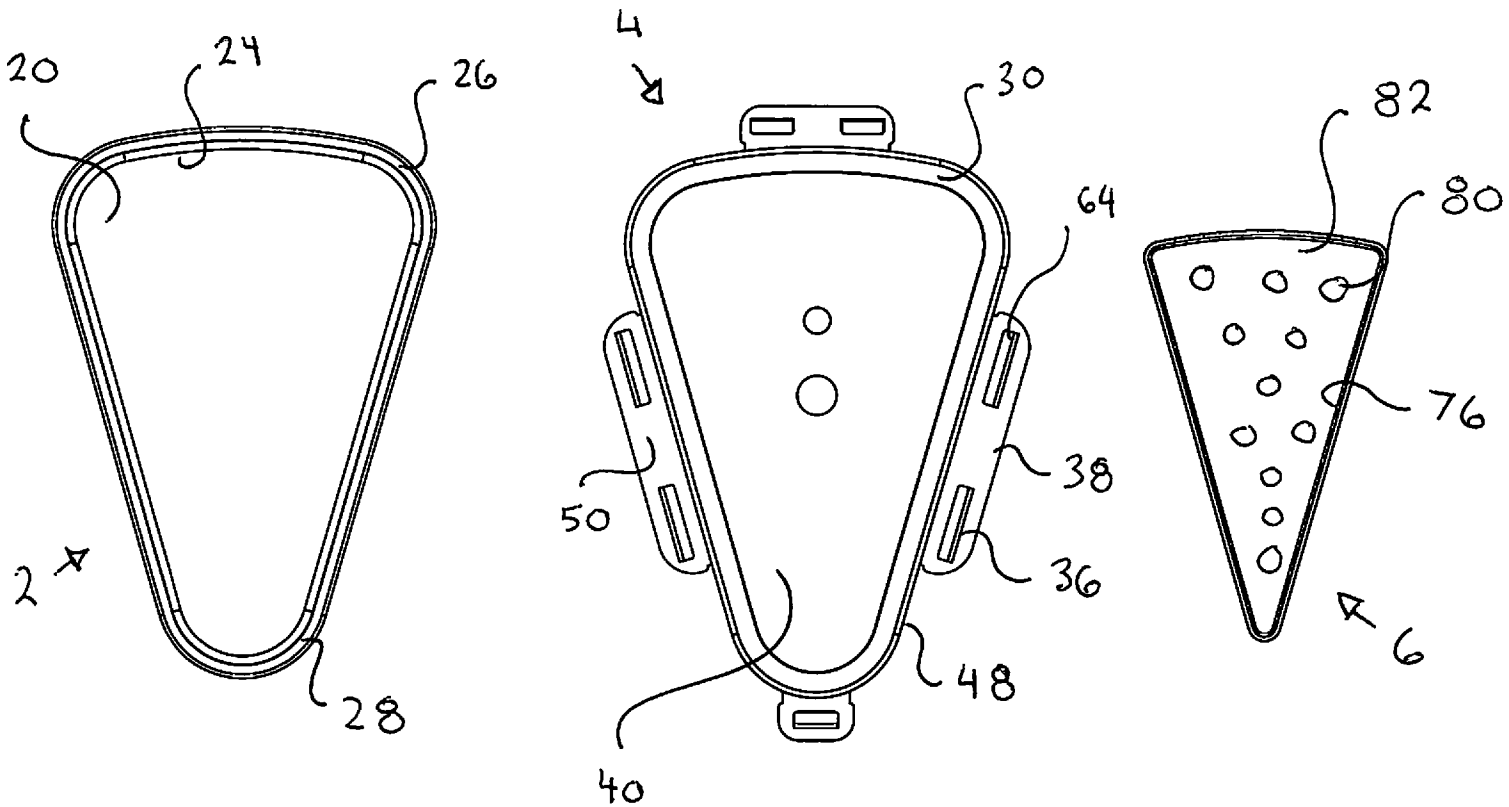
FIG. 2 is a disassembled bottom view of the collapsible pizza storage container, its lid and one of its trays.
Figure 3:
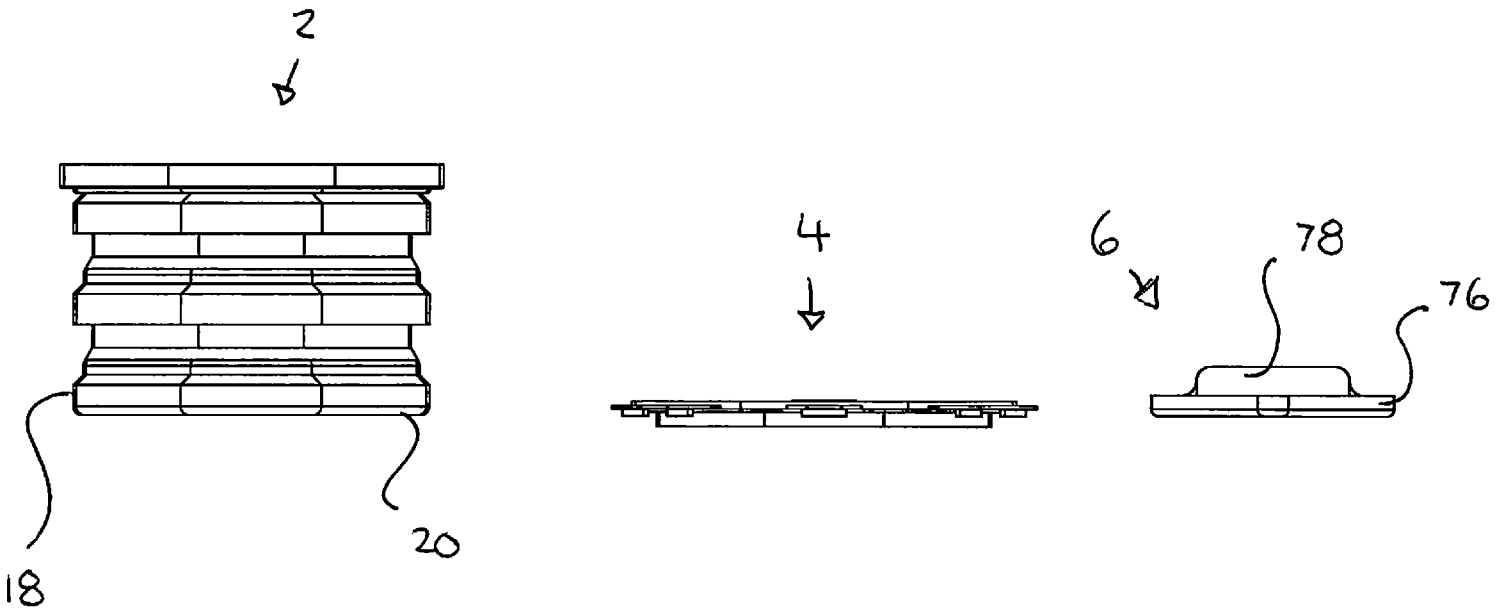
FIG. 3 is a disassembled front side view of the collapsible pizza storage container in its expanded configuration, its lid and one of its trays.
Figure 4:
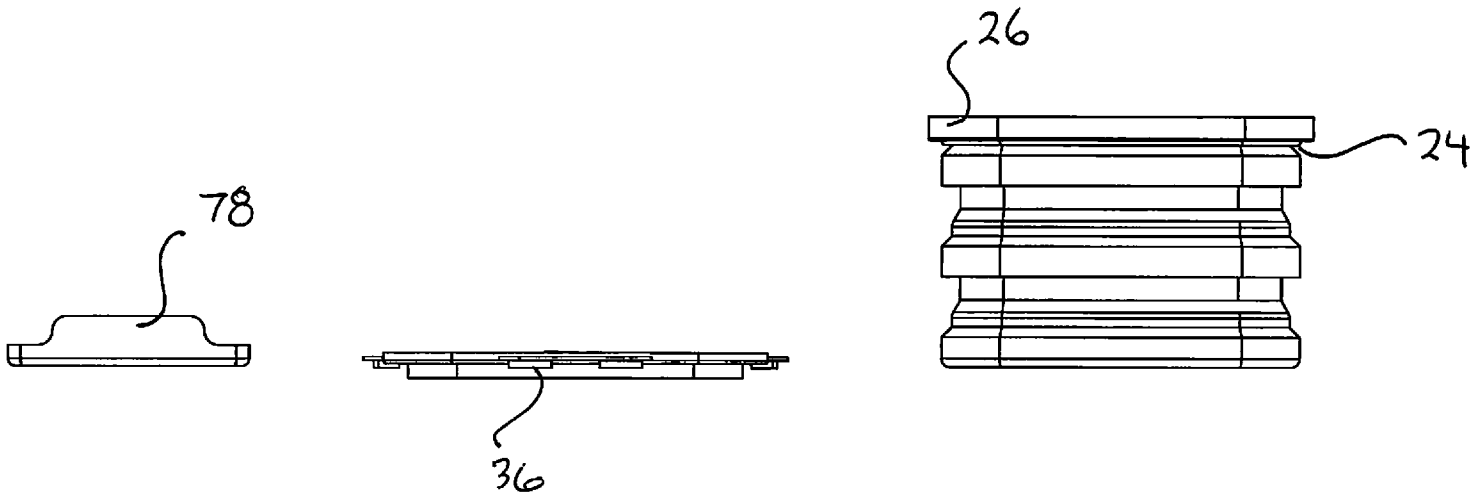
FIG. 4 is a disassembled rear side view of the collapsible pizza storage container in its expanded configuration, its lid and one of its trays.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, elements, and/or components, but do not preclude the presence or addition of one or more other features, elements, components, and/or groups thereof.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "generally triangular shape" or "generally triangular" refers to a geometric configuration of a triangle with rounded corners.

The present invention relates to a novel design for a vertically collapsible generally triangular, pizza storage container with a vented lockable lid and microwaveable separation/serving trays.

Looking at FIGS. 1-4, the collapsible triangular pizza container 2 ("container") can be seen in its expanded configuration with its lid 4 and separation tray 6. The body 6 of the container 2 has a generally Isosceles triangular shape with three sides connected at three rounded corners/vertices 8. Stated otherwise, its overall configuration is that of an isosceles triangular prism with side walls that maintain a similar volume over the height of the pizza container. There are two sides of a same first length 10 that are connected to each other at a front end 12, and one side of a second, shorter length 14, connected to each of the two longer sides 10 at a rear end 16. There is a planar unadorned bottom plate 20 extending across the generally triangular bottom edge 18 of the three sides 10 and 12. The container 2 is made of a flexible food-grade polymer, such a silicon. It is to be noted that these three sides 10 and 14 are not pleat folded in the style of an accordion, rather, use a novel configuration of side wall nestings based on a repeating series of three vertically contiguous layered side wall sections. In the preferred embodiment there are three of these side wall section nestings, although alternate embodiments may have more or less.

Figure 5:
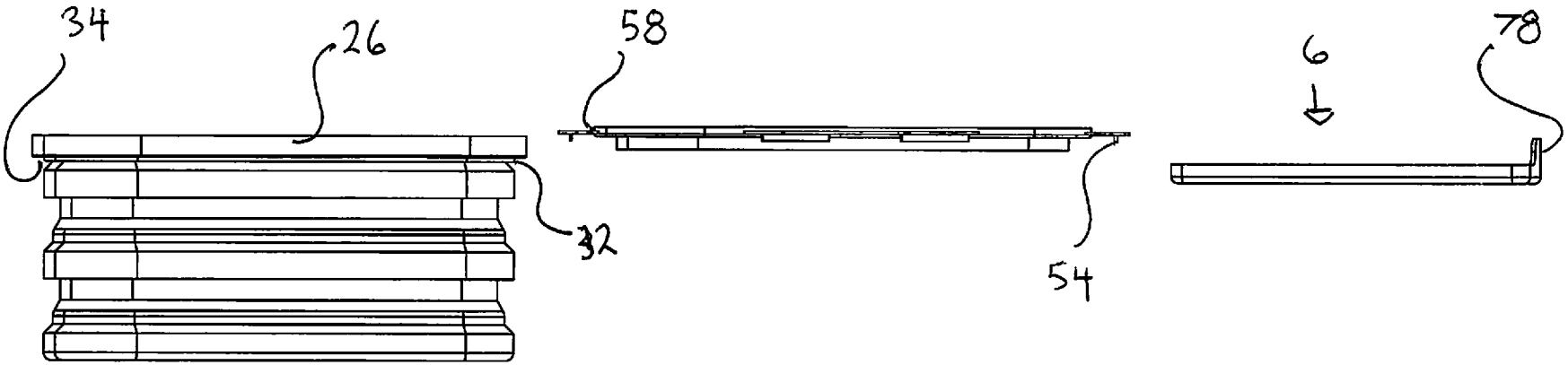
FIG. 5 is a disassembled left side view of the collapsible pizza storage container in its expanded configuration, its lid and one of its trays.
Figure 6:
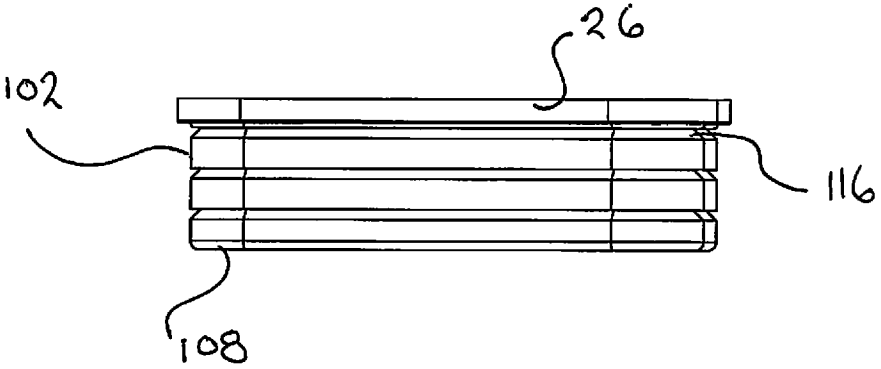
FIG. 6 is a left side view of the collapsible pizza storage container in its collapsed configuration.
Figure 7:
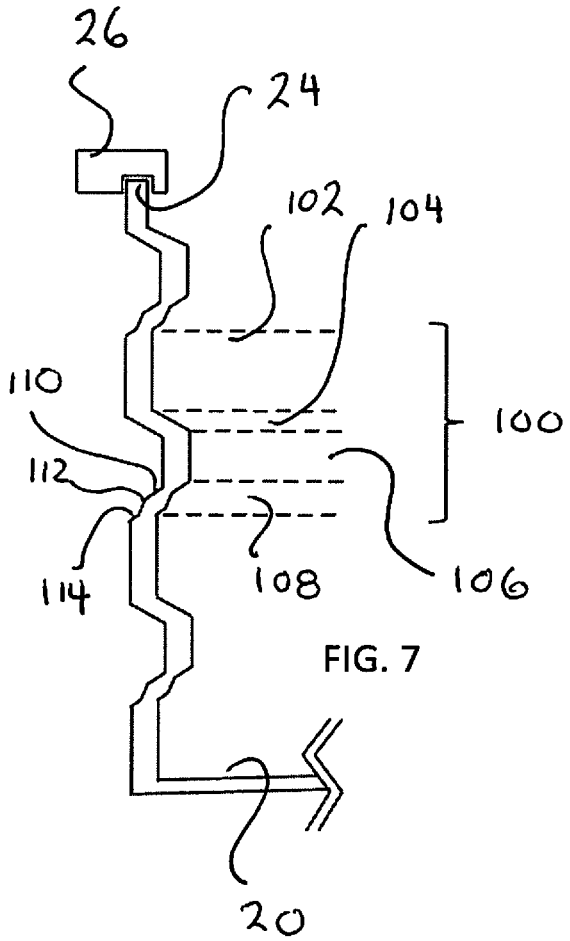
FIG. 7 is a cross sectional view of the side wall of the collapsible pizza storage container.
Figure 8:
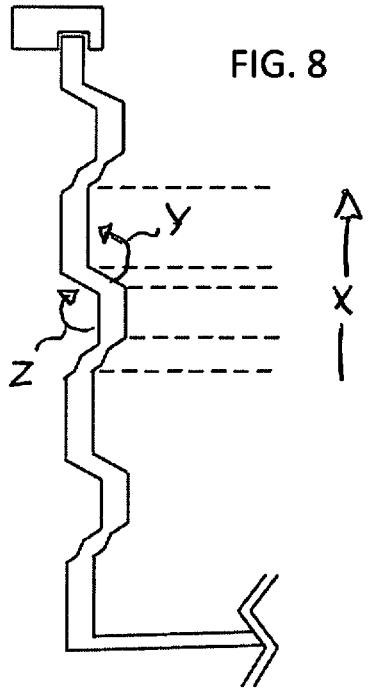
FIG. 8 is a cross sectional view of the side wall of the collapsible pizza storage container showing the direction of side wall segments for a container collapse.

FIGS. 5 and 6, with the container 2 in its expanded and collapsed configurations, take with respect to FIGS. 7 and 8 illustrate the design of the container side walls 10 and 14 and how they function. The container 2, unlike other containers, is designed to have the same cross sectional area for all layered side wall sections, maximizing the internal volume of the container 2 and accommodating identically sized slices of pizza at all vertical levels. The design of the nesting of the side wall sections when expanded, leaves relatively no crevices or hard to get at spots, so washing is simplified. The expanded container 2 (FIG. 5) is approximately two times the vertical height and volume of the collapsed container (FIG. 6). The collapsed container does not nest all of its sections concentrically, rather each section 100 only nests the inner nesting (second) portion 104, the outer nesting (third) portion 106 and the bottom transitional (fourth) portion behind its upper (first) portion 102. Only one half of each section 100 folds and nests behind itself. This design is a vast improvement over accordion style pleat folded containers which does double their vertical height but not the volume between their collapsed and expanded configurations, since each sequentially lower section is smaller in overall size because of their concentric nesting design. Additionally, the accordion style pleats has sharp creases which are hard to clean.

All the side walls 10 and 14, have the identical cross sectional dimensions and configuration. They each have a vertically repeating pattern (in the preferred embodiment there are three repeats) of identical side wall sections 100. Each section has four, formed, contiguous vertical portions. Vertically from the top, each section has the following four portions: the upper (first) portion 102, the inner nesting (second) portion 104, the outer nesting (third) portion 106 and the bottom transitional (fourth) portion, 108. The upper portion 102 presents approximately ⅓ of the outer side wall of the pizza storage container when the container 2 is collapsed. The middle two portions, the inner nesting (second) portion 104 and the outer nesting (third) portion, 106 hinge or fold to nest sequentially adjacent, and behind the upper (first) portion 102. The transitional (fourth) portion 108 provides the connectivity to the upper portion 102 of the next, lower side wall section 100 from the nested sections 104 and 106. It angles outward such that all of the upper portions 102 in the various side wall sections 100 are vertically aligned and the container 2 presents itself as an isosceles triangular prism with side walls that maintain a similar volume over the height of the container.

Looking closer at the four side wall cross sections 100 of FIGS. 7 and 8, it can be seen that the upper (first) portion 102, is a vertical linear section having a first vertical height. The inner nesting (second) portion 104, is a linear section that hingedly extends from the bottom of the upper portion 102, at an inward angle (toward the center of the container 2). The outer nesting (third) portion 106 is another vertical linear section having a second vertical height less than the first vertical height. The bottom transitional (fourth) portion, 108, extends outward (away from the center of the container 2) and has a first second and third linear regions 110, 112 and 114, at different angles to allow it to extend from the bottom of the outer nesting (third) portion 106 while avoiding contact with the upper (first) portion 102, and leaving a small gap 116 between the upper first portions 102. The first vertical height of the upper portion 102, approximates the combined vertical heights of the inner nesting portion 104, the outer nesting portion 106 and the bottom transitional portion 108.

In operation, to collapse the container 2 an upward force (denoted as arrow X in FIG. 8) is exerted on the bottom plate 20. This causes the inner nesting (second) portion 104 to pivot or hinge vertically upward and behind the upper portion 102 as indicated by arrow Y in FIG. 8. At the same time, outer face of the outer nesting (third) portion, 106 pivots or hinges vertically upward toward the outer face of the inner nesting (second) portion 104 as indicated by arrow Z, so as to contact it, and to reside in a nested configuration behind the inner nesting (second) portion 104 which resides in a nested configuration behind the upper (first) portion 102. In this nested configuration, the transitional (fourth) portion 108 then angles the bottom of the side wall section 100 toward the outside of the container, ending in line vertically with the upper portion 102 of the next, lower side wall section 100.

There is a generally triangular rigid polymer seal ring 26 affixed to the top peripheral edge 24 of the container's flexible sides 10 and 14. The seal ring 26 is a solid generally triangular ring, with a planar top face 28. The planar top face 20 serves as a surface for the compression of a compressible gasket 30 frictionally housed in a gasket groove about the periphery of the lid 4. In alternate embodiments the gasket 30 may be affixed to the seal ring 26 and compressed on the inner face of the lid 4. The seal ring 26 extends cantilevered out beyond the outer perimeter of the top edge 32 of the side walls 10 and 12. This cantilever 34 of the seal ring is what the lock tabs 36 of the hinged locking wings 38 extending from the lid 4 frictionally engage and ensure the lid 4 stays on and the gasket 30 stays compressed guaranteeing freshness of the container's contents.

The lid 4 also has a generally triangular shape and a planar top face 40 with an small orifice 42 and a large orifice 44 formed therethrough. The lid 4 is made of a rigid, transparent polymer and has a series of hinged locking wings 38 extending from the edge 48 of the lid 4. Each locking wing 38 has a top face 50 and a bottom face 52 with at least one lock tab 54 projecting perpendicularly from its bottom face 52. The hinges 56 are merely pre bent sections 58 of the locking wings 38 where the locking wing 38 attach to the lid's outer edge 48. These hinges 58 do not extend the full length of the locking wings 38. The lock tabs 54 are formed from linear slots 64 cut from the locking wings 38 and formed to stand perpendicularly from the bottom face 52. These linear slots 64 also minimize the rigidity of the locking wings 38 to help with flexing of the locking wings 38 when the lid 4 is latched to the container 2.

The lid 4 has a compressible polymer gasket 30 affixed thereto. In the preferred embodiment the gasket 30 is frictionally housed in a generally triangular gasket groove (not visible in FIGS.) that runs around the outer peripheral edge of the lid 4. However, in alternate embodiment, the gasket 30 may be injection molded onto the lid 4 or the seal ring 26. When the lid 4 is fitted onto the container 2, gasket 30 abuts the seal ring 17 the latching of the locking wings 38 aligns the lid 4 and its gasket 30 onto the container 2 so that the compressible gasket 30 is properly seated onto the planar top face of the seal ring 17 prior to compression by the latching of the last locking wing 38.

The vent cap 70 is a flexible plug sized to frictionally fit within the large orifice 44 of the lid 4 and is connected to a keeper 72 which is a smaller flexible deformable bulbous shaped plug with a bulbous configuration that has been passed through the small orifice 42 from the top face of the lid and is constrained on the bottom side of the lid 4. This arrangement allows the vent cap 70 to be inserted or removed from the large orifice 44 of the lid 4 and not separated from the lid 4.

The plug configuration of the vent cap 70 is compressible and pliable, and sized slightly larger than the large 44. With the application of side to side and downward pressure on the top face of the vent cap 70 its plug shape will frictionally reside in the large orifice 44. In alternate embodiments the vent cap 70 may also have a bulbous configuration.

The trays 6 also share the same generally triangular configuration as the container 2 and lid 4, although dimensionally are slightly smaller than the container's bottom plate 20 so a tray 6 may be used on even the smallest of pizza slices stacked on the bottom of the container 2. The trays of the preferred embodiment 6 have a planar top face 82 and a peripheral lip 76 extending around the tray 6. This holds the slice of pizza on the tray 6 as well as any oils that drip from the pizza during the microwave process. On one side (end) of the tray 6, there is a raised finger tab 78 for lifting the tray 6 and its slice of pizza.

The trays 6 may be made of a polymer or of a metal. If a metal tray 6 is used, when the pizza slice is heated in the microwave, the tray 6 absorbs the microwaves and cooks food from the hot tray bottom, to make the tray 6 like a fry pan and grill plate. To an extent, it also shields microwaves from entering the food lessening the damage to the nutrients of the food from microwave penetration. Because the design of the tray 60 has smooth, rounded and planar exterior surfaces (IE those without any sharp edges or pointy angles), microwaving them will not cause a build-up of electromagnetic energy, which will cause sparks and fires.

In alternate embodiments (FIG. 2 tray) the tray 6 may have a series of spaced dimples 80 arcing convexly upwards. The dimples 80 allow for heat to transfer directly to the pizza bread. These dimples 80 allow moisture to escape, so the pizza crust becomes crispy and brown, which along with the hot tray, crisps the crust. The dimpled tray also reduces the surface area that the bottom of each tray 6 will have with the slice of pizza that the tray rests on. This minimizes the transfer of oils and greases from the slice of pizza to the bottom face 82 of the tray 6 and also prevents the stacked pizza slices from sticking together.

The expandable pizza container is used to store (refrigerate) multiple slices of pizza stacked atop each other and separated by triangular trays that serve to prevent the pizza slices from sticking together, to provide a drip tray to collect oils and greases when microwaved, and to act as a serving tray for single slices. The container has a vented lid with a series of locking tabs arranged about its sides.

In use, the lid 4 is removed, and the bottom of the container 2 pressed downward to expand the side wall nestings. Slices of pizza are layered into the container from the bottom up, separated by the insertion of triangular, microwaveable trays (planar side up) between the pizza slices. When all slices are inside, the container lid is pressed into place ensuring that the lid's flexible gasket is compressed on the container's rigid top seal ring and the vent cap is free. The locking wings 38 are rotated from a horizontal to a vertical position until the gasket is compressed and the lock tabs 36 on the locking wings 38 are frictionally captured beneath the cantilever 24 of the seal ring 26. The bottom 20 of the container 2 is gently pressed upward and the nestled sides collapsed until the top slice of pizza is in close proximity to the lid 4. When this compartment collapse is undertaken, the vent cap 70 will lift up slightly to allow the compressed air to escape, helping ensure freshness.

When an individual slice of pizza is desired, the lid's locking wings 38 are rotated to an upward, horizontal position to release the lid 4 from its frictional engagement with the container and decompress the compressible gasket. The lid 4 is removed. The tray 6 under the top slice of pizza with the slice of pizza thereon is removed and placed in the microwave. Once heated the tray 6 and slice of pizza are removed from the microwave and served as a unit. The above procedure is repeated to further collapse, vent and seal the container, and the container is again ready for storage.

One of the other features of this design of pizza storage container 2, is that multiple pieces of pizza may be reheated in the microwave at the same time. In previous containers with their inward tapering design, the slices of pizza had to be stacked from the smallest to the largest. Often this meant trimming the slices to fit the different sections of the container. Thus, there was not a uniform microwaveable vertical density resulting in the edges of the top slice of pizza over cooking via the microwaves reflected off of the microwave's inner cavity. While certain features and aspects have been described with respect to exemplary embodiments, one skilled in the art will recognize that numerous modifications are possible. Consequently, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

The invention claimed is:

1. A collapsible, pizza storage container, comprising:

a flexible, isosceles triangular prism shaped container with side walls that maintain a similar volume over a height of said container, said container having three side walls joined at rounded vertices, and a planar bottom plate extending perpendicularly between a bottom edge of said side walls;

a seal ring affixed to a top edge of said side walls, said seal ring having a cantilevered outer edge that extends outward beyond said top edge;

a lid, engageable onto said seal ring;

wherein said side walls are formed from a repeating series of identically sized and identically configured, vertically contiguous, layered, side wall sections, each said section made of four vertical portions, an upper portion, an inner nesting portion, an outer nesting portion, and a bottom transitional portion;

wherein said upper portion, is a first vertical linear section with said first vertical height, said inner nesting portion is a linear section that hingedly extends from a bottom of said upper portion at an inward angle toward an interior of said pizza storage container, said outer nesting portion is second vertical linear section with a second vertical height that is less than said first vertical height, and said bottom transitional portion extends outward away from said interior of said pizza storage container and has a first linear region, a second linear region and a third linear region each at a different angle to allow said bottom transitional portion to extend from the bottom of the outer nesting portion while avoiding contact with said upper portion, and leaving a small gap between said upper first portions, and wherein said inner nesting portion, said outer nesting portion, and said bottom transitional portions all fold to reside in a nesting configuration within said pizza storage container, adjacent to said top portion.

2. The collapsible, pizza storage container of claim 1 further comprising:

a compressible, gasket affixed adjacent to a periphery edge on said lid.

3. The collapsible, pizza storage container of claim 1 further comprising:

a planar triangular tray with a top face, a bottom face, and a peripheral lip formed there about said top face.

4. The collapsible pizza storage container of claim 2 further comprising:

a series of hinged locking wings extending from said lid, said locking wings having a lower face with at least one lock tab extending perpendicularly from each lower face of said locking wings, and engageable about said cantilevered outer edge.

5. The expandable pizza storage container of claim 4, further comprising:

an openable vent plug connected to said lid.

6. The expandable pizza storage container of claim 1 wherein a first vertical height of said upper portion when said container is in an expanded configuration, equals a combined vertical height of said inner nesting portion, said outer nesting portion, and said bottom transitional portion.

7. The expandable pizza storage container of claim 1 wherein the number of identical, vertically contiguous, layered, side wall sections is three.

* * * * *